US006042529A

United States Patent [19]

Hübler et al.

[11] Patent Number: 6,042,529

[45] Date of Patent: Mar. 28, 2000

[54] CONFIGURATION FOR FOLDING SHEETS

[75] Inventors: Uwe Hübler; Detlef Lütdke; Jürgen Quass, all of Berlin, Germany

[73] Assignee: Francotyp-Postalia AG & Co., Birkenwerder, Germany

[21] Appl. No.: 08/815,207

[22] Filed: Mar. 12, 1997

[30] Foreign Application Priority Data

Mar. 12, 1996 [DE] Germany ..... 196 11 788

[51] Int. Cl.[7] ..... B31F 1/10

[52] U.S. Cl. ..... 493/434; 493/435; 493/442; 493/445

[58] Field of Search ..... 270/8, 20.1, 46; 493/434, 435, 405, 442, 445, 415, 416, 433, 430

[56] References Cited

U.S. PATENT DOCUMENTS

| | | | |
|---|---|---|---|
| 4,265,437 | 5/1981 | Reist et al. | 493/435 |
| 4,403,981 | 9/1983 | Wuthrich | 493/442 |
| 4,643,705 | 2/1987 | Bober . | |
| 4,824,426 | 4/1989 | DeFresne | 493/433 |
| 4,898,570 | 2/1990 | Luperti et al. | 270/46 |
| 5,135,465 | 8/1992 | Hirahara | 493/442 |
| 5,169,376 | 12/1992 | Ries et al. | 493/445 |
| 5,322,498 | 6/1994 | Lehmann et al. . | |
| 5,738,620 | 4/1998 | Ebner et al. | 493/445 |

FOREIGN PATENT DOCUMENTS

| | | | |
|---|---|---|---|
| 0038942 A1 | 11/1981 | European Pat. Off. . | |
| 0 211 562 B1 | 2/1987 | European Pat. Off. . | |
| 0211562 A2 | 2/1987 | European Pat. Off. . | |
| 0583587 A1 | 2/1994 | European Pat. Off. . | |
| 101 875 | 11/1973 | Germany . | |
| 2912839 | 10/1980 | Germany | 493/445 |
| 4018709 A1 | 1/1991 | Germany . | |
| 1050892 | 10/1983 | U.S.S.R. | 493/442 |
| 727920 | 4/1955 | United Kingdom . | |

*Primary Examiner*—Eugene L. Kim
*Attorney, Agent, or Firm*—Herbert L. Lerner; Laurence A. Greenberg; Werner H. Stemer

[57] ABSTRACT

A configuration for folding sheets with an increased functional reliability and field of use folds sheets of different lengths through the use of folding rolls and an adjustable stop in such a way that automatic matching of a folding gap to a thickness of a material to be folded is carried out and a folding blade and a folding pocket can be dispensed with, while executing the functions of simple folding, multiple folding, turning and smooth passage. The configuration includes folding rolls which rest against each other in a resilient manner and have a given diameter. Pressure rolls with a diameter which is smaller than half the given diameter are disposed in such a manner as to be adjustable and axially symmetrical in relation to the folding rolls. Furthermore, a stop can be adjusted into a region between the pressure rolls and at the same time is a diverting element. The pressure rolls are subdivided in the axial direction defining gaps therebetween and the likewise subdivided stop has an adjustment path projecting into the gaps. A conveying device in the form of additional driven guide rolls and further pressure rolls assigned thereto is provided as required.

20 Claims, 8 Drawing Sheets

Fig. 8a
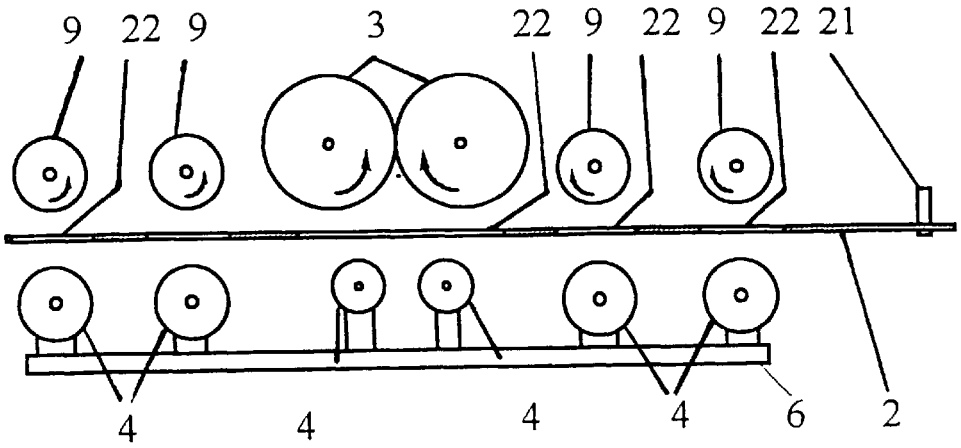
Fig. 8b
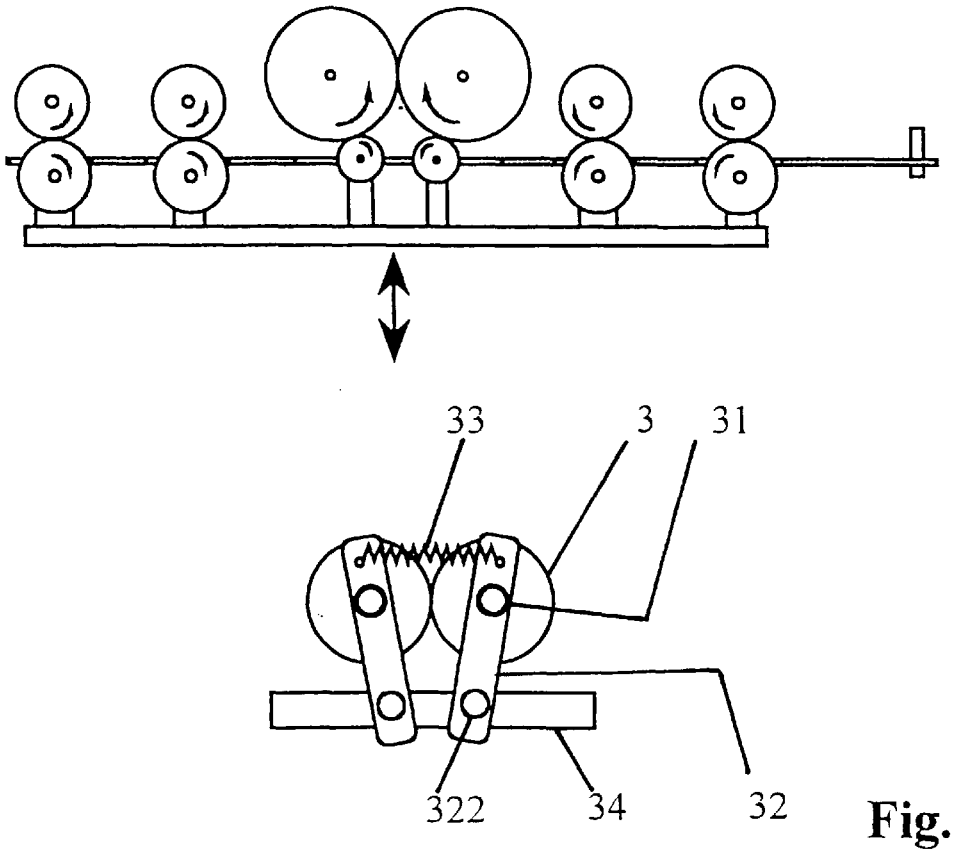
Fig.9

CONFIGURATION FOR FOLDING SHEETS

BACKGROUND OF THE INVENTION

FIELD OF THE INVENTION

The invention relates to a configuration for folding sheets through the use of folding rolls and an adjustable stop.

Folding devices are needed for the preparation of sheets of letter paper to be inserted into envelopes or for the folding of sheets for bookbinding. Depending on the application, the sheets are to be folded simply in the middle if, for example, A4 format sheets are to be filled into C5 format envelopes, or are to be folded twice if, for example, A4 format sheets are to be filled into C6 format envelopes. In the latter case, the fold can be executed in a Z shape or as a so-called letter fold. If such folding devices are an integral part of sorting and enveloping devices, it is from time to time also necessary, for example in the case of account statements or bookkeeping documents, for the sheets to pass unfolded through the folding device.

Two folding principles have principally become widespread, namely the blade folding principle which is disclosed in German Published, Non-prosecuted Patent Application DE 40 18 709 A1 and German Patent DE 43 24 199 C1, and the buckle folding principle which is disclosed in German Patent DE 40 12 859 C2 and Published European Patent Applications 0 583 587 A1, 0 595 105 A1 and 0 641 733 A1.

In the case of the blade folding principle, the sheets to be folded are pressed through a gap between two folding rolls with the use of a sharp-edged blade which tapers to a point.

In the case of the folding device according to German Patent DE 43 24 199 C1, each folding roll is mounted in bearing levers which are adjustable about pivot axes. A folding roll gap is set through the use of a pivoting drive which engages on one bearing lever. The setting of the folding roll gap must be matched exactly to the thickness of the material to be folded, that is one or more sheets, and of the folding blade. Incorrect settings can lead to damage to the material to be folded or to folding errors. At each change of thickness of the material to be folded, the folding roll gap has to be adjusted anew. In order to achieve symmetrical pivoting of the oppositely disposed bearing levers, they have extensions which can be adjusted in relation to each other through the use of a compression screw and a fixing screw. The outlay for that folding device, in particular for the linear drive necessary for the first bearing lever and the adjustment, is correspondingly large.

In the case of the buckle folding principle, there are at least one pair of folding rolls and a folding pocket. The material to be folded is led between transport rolls and firstly into the folding pocket as far as a stop. The opening of the folding pocket, the folding pocket mouth, is located directly adjacent the folding region of the folding rolls. When the trailing end of the material to be folded is moved further by the transport rolls, a build-up occurs and the material to be folded bends in front of the folding pocket mouth into the folding region of the folding rolls, it is gripped by the latter and folded. In order to ensure that no curvature of the material to be folded occurs within the folding pocket, it must be narrow, corresponding to the thickness of the material to be folded, that is to say the play is closely limited. It is normally the case that one to five sheets can be folded simultaneously using the folding pocket method, if it is assumed that a sheet can weigh between 30 and 80 g. However, there is constantly the requirement to fold a larger number of sheets simultaneously.

A buckle folding machine which is known from Published European Patent Application 0 583 587 A1 has an adjustable stop rail in the folding pocket. In order to determine the folding length, corresponding to the penetration depth of the material to be folded into the folding pocket, and the folding shape, the stop rail can be set individually with the aid of an electric drive, and settings are carried out manually or through the use of a programmable control device. The stop rail has a plurality of stop fingers on that side facing the folding pocket mouth. The stop fingers have front end surfaces, lying on a common plane, which form the paper stop in the folding pocket. The stop rail can moreover assume a forward deflection position in which the front end surfaces jointly serve as a paper deflector and close the folding pocket mouth. The material to be folded and arriving at the folding pocket mouth is then deflected past the folding pocket, through the folding rolls, either to a following folding pocket or into an enveloping machine. In any case, by using that portion of the buckle folding machine, it is possible to realize both the "folding" function" and the "smooth passage" function, as mentioned at the outset. However, there are still problems with the folding width of the folding pocket.

Furthermore, a buckle folding machine which is known from Published European Patent Application 0 595 105 A1 has at least one folding pocket and folding rolls which can be set to different folding gap widths and can be moved pivotably and in a resilient or sprung manner with respect to each other. The folding rolls are rotatably mounted in two-armed pivoting lever pairs and, together with a further folding roll in each case, form a drawing-in and/or folding point. The inlet gap of the folding pocket has a minimum width and can be altered in a resilient manner according to the thickness of the material to be folded. The bottom and the top of the folding pocket are formed by grids which are pivotable about axes on the folding pocket base. The end sections on the inlet side of the grids are fastened on angle rails which run transversely to the filling direction and are coupled on the other side to the pivoting lever pairs of the folding rollers. Consequently, at the same time that the folding gap of the folding rolls is altered, the inlet gap of the folding pocket is adapted. However, the folding pocket in that way is normally of a wedge-shaped profile with a variable wedge width and the tip of the wedge being essentially of equal thickness. Therefore, the folding pocket mouth and the first two thirds of the folding pocket can be matched to the thickness of the material to be folded, but jamming at the folding pocket base is not thereby ruled out. An inlet barrier and an adjustable stop are not present in that buckle folding machine. Accordingly, it is only possible to process sheets of one length.

Finally, a further device for the folding of sheets or layers of sheet-like materials through the use of folding rolls is known from Published East German Patent Application DD-101 875, in which a pair of pressure rolls is disposed so as to be axially symmetrically adjustable in relation to the folding pair of rolls. The axial distance between the pressure rolls is smaller than that of the folding rolls. In that way, a folding blade can be dispensed with. All of the solutions mentioned above furthermore have the disadvantage of not being able to process sheets with a length smaller than the set folding length. However, sheets of that type are frequently contained as enclosures in mailings.

SUMMARY OF THE INVENTION

It is accordingly an object of the invention to provide a configuration for folding sheets of different lengths and in great numbers through the use of folding rolls and an adjustable stop, which overcomes the hereinaforementioned disadvantages of the heretofore-known devices of this general type, in which a folding gap is automatically matched to a thickness of a material to be folded, in which it is possible to dispense with a folding blade or a folding pocket and in which the functions of single folding, multiple folding, letter fold or Z fold, continuous folding and smooth passage can be executed. The purpose of the invention is an increase in the functional reliability and in the field of use.

With the foregoing and other objects in view there is provided, in accordance with the invention, a configuration for folding sheets, comprising a pair of axially parallel folding rolls resting resiliently on each other and having a given diameter; a pair of axially parallel pressure rolls axially symmetrical to the folding rolls, adjustable in relation to the folding rolls, disposed upstream of the folding rolls in a sheet running direction, and having a diameter less than half of the given diameter, the pressure rolls being distributed in axial direction defining gaps therebetween; and a subdivided stop acting as a diverting element and having an adjustment path or region projecting or opening into the gaps between the pressure rolls.

In accordance with another feature of the invention, if necessary there is provided a device for conveying sheets with lengths smaller than given folding lengths.

In accordance with a further feature of the invention, there is provided a lifting table on which the pressure rolls are fastened in common.

In accordance with an added feature of the invention, there is provided a sliding table for sheets, the sliding table having cutouts matched to the pressure rolls in a lifting region of the pressure rolls, and the sliding table having a guide underneath the folding rolls in the adjustment region of the stop for lowering and raising the stop.

In accordance with an additional feature of the invention, there is provided a sliding table for a sheet, the sliding table having cutouts matched to the pressure rolls in a lifting region of the pressure rolls.

In accordance with yet another feature of the invention, the sliding table is inclined downward in the sheet running direction.

In accordance with yet a further feature of the invention, the stop has a flat part facing the sliding table and a concave part facing away from the sliding table being matched to a curvature of the folding rolls.

In accordance with yet an added feature of the invention, the folding rolls are disposed above and the pressure rolls are disposed below the sliding table.

In accordance with yet an additional feature of the invention, the folding rolls are disposed below and the pressure rolls are disposed above the sliding table.

In accordance with again another feature of the invention, there are provided axles for the folding rolls, fixed bearings having slots formed therein for mounting the axles, and tension springs interconnecting the axles.

In accordance with again a further feature of the invention, there are provided pivotable bearings mounting the folding rolls, and tension springs interconnecting the pivotable bearings.

In accordance with again an added feature of the invention, the tension springs have a maximum spring travel corresponding to a maximum thickness of a material to be folded and to be processed.

In accordance with again an additional feature of the invention, there are provided guide rolls parallel to the folding rolls and driven at the same peripheral speed, and further pressure rolls assigned to the guide rolls and parallel to the folding rolls.

With the objects of the invention in view there is also provided an assembly for folding sheets, comprising a plurality of the folding configurations disposed alternately and mutually orthogonally offset in a sheet running direction.

Careful and secure folding is enabled through the use of the combination of actively driven folding rolls and passive pressure rolls having a diameter smaller than half the diameter of the folding rolls. The resilient or sprung mounting of the folding rolls enables automatic matching of the folding gap to the thickness of the material to be folded and the simultaneous folding of a greater number of sheets. The appropriate selection of the spring force is routine. Since the pressure rolls are driven by the folding rolls directly or through the material to be folded, synchronicity between all of the rolls, and symmetrical paper drawing into the folding gap, are always ensured. The pressure rolls serve the purpose of ensuring both that the curving of the material to be folded is carried out in the desired direction, and that the folding process takes place. Since only round elements act on the material to be folded, damage to the material to be folded, as in the case of the blade folding principle, is completely ruled out. Using the pressure rolls, which are adjustable through the use of a lifting table, and the stop which can be adjusted into the folding region, it is even possible to realize the "smooth passage" function. In the first case, the lifting table with the contact rolls is moved against the folding rolls and the stop is pushed between the folding rolls before the sheets have run into the region between the stop folding rolls.

It is even possible to realize the function of "smooth passage with turning". In this case, the lifting table with the pressure rolls is moved against the folding rolls after the sheets have left the region between the deflecting element and the folding rolls in the direction of the stop, but are still located between the rear pressure and folding rolls.

If an appropriate number of configurations according to the invention are disposed offset one after another, it is then possible to carry out continuous folding or accordion folding. This is simple to realize through the use of an appropriate setting of the stops.

The configuration using more than two pressure rolls and additional driven guide rolls assigned to the latter is suitable for particularly short sheets or sheets which are not to be folded.

Other features which are considered as characteristic for the invention are set forth in the appended claims.

Although the invention is illustrated and described herein as embodied in a configuration for folding sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 8*a* and 8*b* are cross-sectional views showing a configuration for folding short sheets; and FIG. 9 is a cross-sectional view showing details of a mounting of folding rolls in pivotable bearings.

DESCRIPTION OF THE PREFERRED EMBODIMENTS

Figure 1:
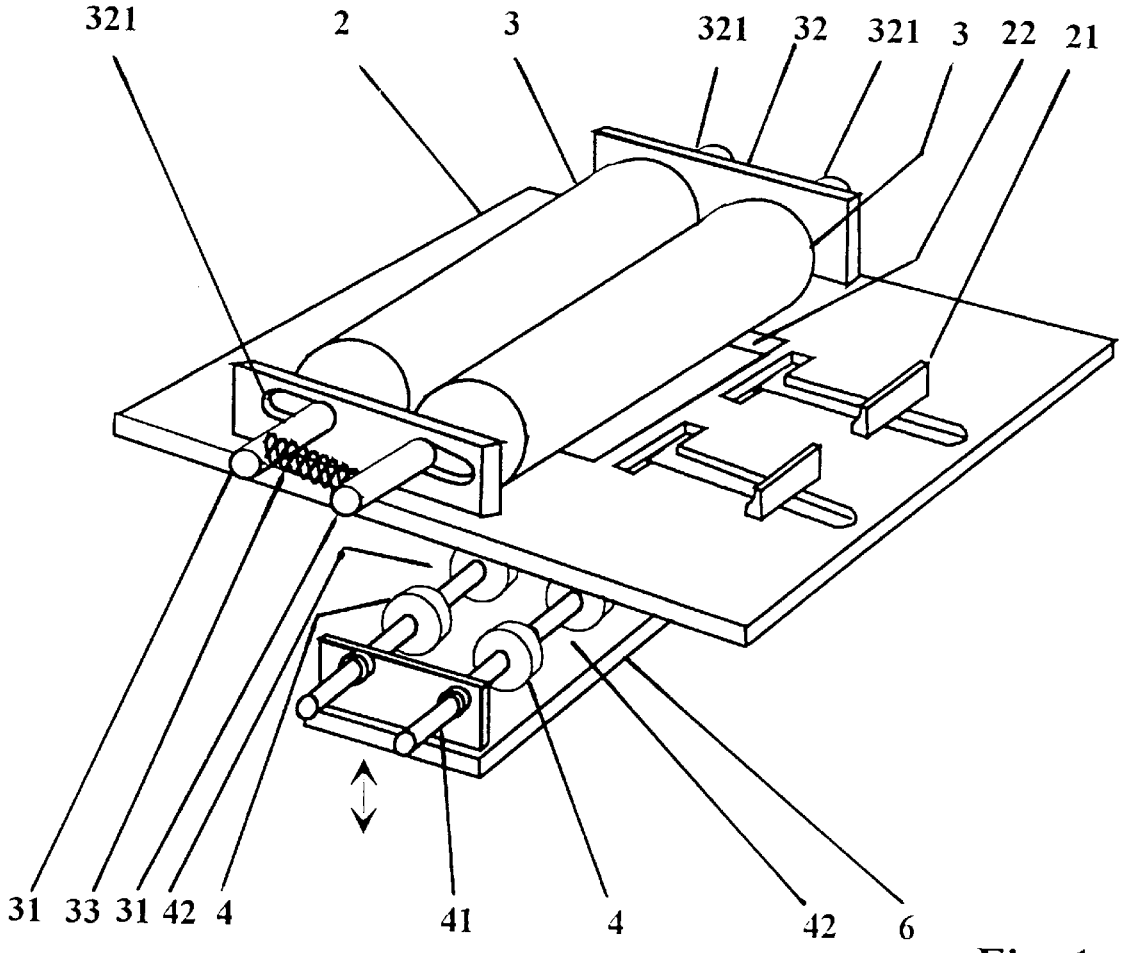
FIG. 1 is a diagrammatic, perspective view of a folding device.

Referring now in detail to the figures of the drawings, which are partly diagrammatic for the purpose of simplification and better comprehension, and first, particularly, to FIG. 1 thereof, there is seen a configuration according to the invention for folding sheets, including a sliding table 2 on which a pair of folding rolls 3 in bearings 32 and a stop 21 are adjustably disposed in slots that are not designated in greater detail. The bearings 32 are provided with slots 321, in which the folding rolls 3 are held rotatably and displaceably through the use of axles or shafts 31 thereof. Tension springs 33 which are clamped between the axles 31 act in such a way that the folding rolls 3 rest against one another in a frictional manner or they are respectively adapted to material to be folded that has a different thickness, for clamping the material between them. The sliding table 2 preferably assumes a sloping position at an angle of 35°, but for reasons of simplified representation, this is not taken into account in the drawing. A pair of pressure rolls 4 on axles or shafts 41 is supported underneath the sliding table 2 on a lifting table 6 which is adjustable parallel to the latter. The lifting table 6 is positioned in relation to the sliding table 2 in such a way that the pressure rolls 4 lie axially symmetrically in relation to the folding rolls 3. The sliding table 2 has cutouts 22 matched to the pressure rolls 4 in a lifting region of the pressure rolls.

The pressure rolls 4 are subdivided in the axial direction, and the stop 21, which is likewise subdivided in a non-illustrated manner, can be displaced between the axles 41 into gaps 42 between the pressure rolls 4.

Figure 2A:
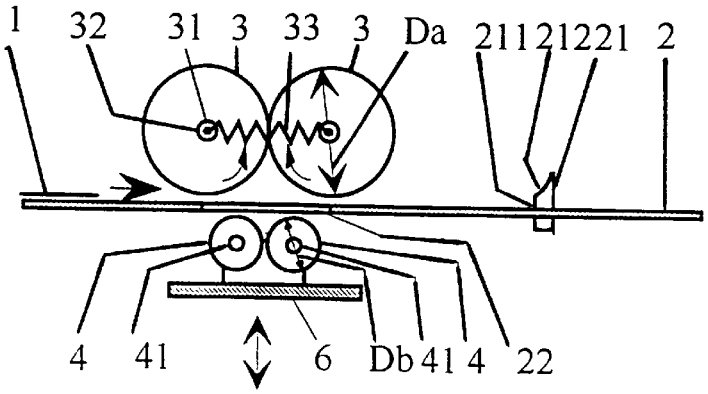
FIGS. 2*a*–2*d* are cross-sectional views showing a sequence of a folding procedure using a configuration according to FIG. 1.

The diameter Db of the pressure rolls 4 is less than half the diameter Da of the folding rolls 3, as is shown in FIG. 2*a*.

A sequence of a folding process using the configuration according to the invention is represented diagrammatically in FIGS. 2*a*–2*d*.

Figure 2B:
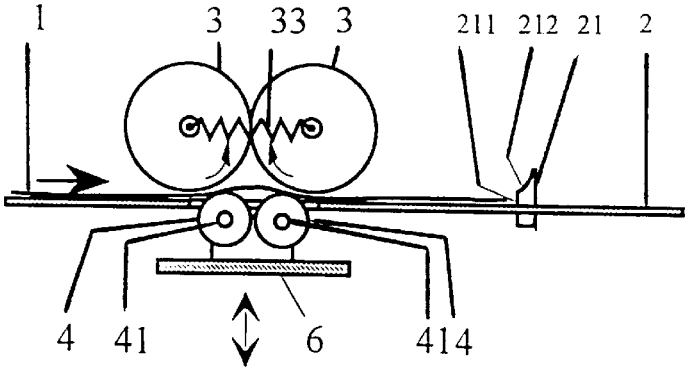
Figure 2C:
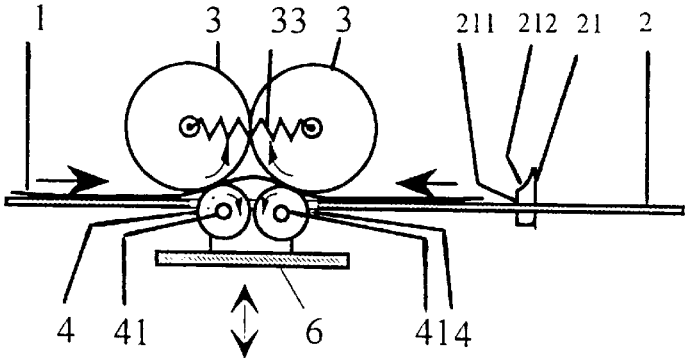
Figure 2D:
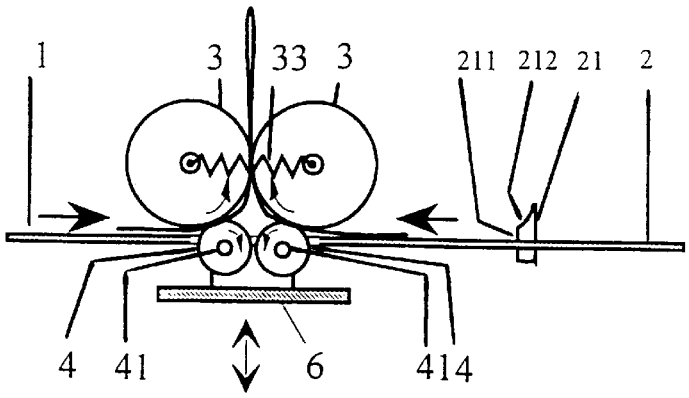

According to FIGS. 2*a* and 2*b*, a sheet 1 is moved on the sliding table 2 in the direction of the stop 21. The stop 21 is set appropriately to the sheet length and the desired folding length. The stop 21 has a flat shape in a portion 211 adjacent the sliding table 2. A more remote portion 212 is constructed to be concave, matching the curvature of the folding roll 3. The sliding table 6 is initially lowered. In this case, it is intended that the sheet 1 be folded in the middle. After the sheet 1 has reached the stop 21, the lifting table 6 is moved upwards until the pressure rolls 4 press the sheet 1 against the folding rolls 3, as is seen in FIGS. 2*b* and 2*c*. As a result of the smaller diameter of the pressure rolls 4, the sheet 1 is preoriented in the direction of the folding rolls 3 before a clamping effect between the pressure rolls 4 and the folding rolls 3 occurs. As is seen in FIGS. 2*c* and 2*d*, the sheet is pressed into the region between the folding rolls 3, is gripped by the latter, folded and pushed further. At the same time, the folding rolls 3 are automatically pushed away from each other by twice the sheet thickness, counter to the spring force of the tension spring 33.

Figure 3:
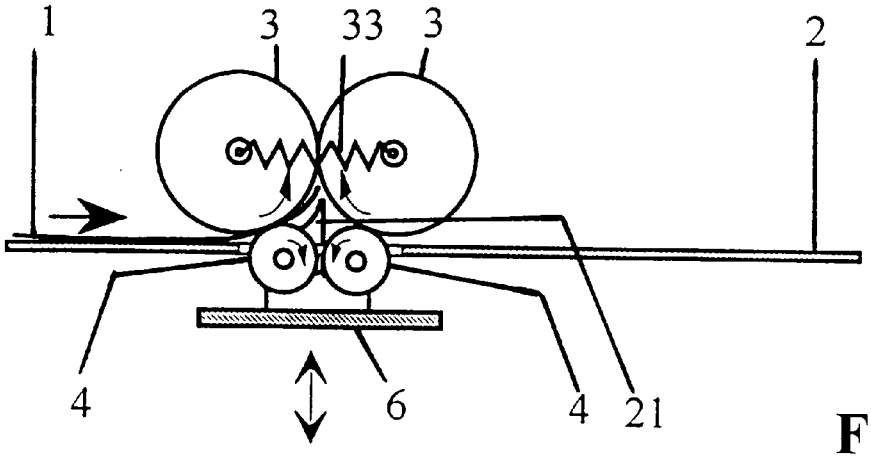
FIG. 3 is a cross-sectional view showing a sequence for a "smooth passage" function with the aid of a stop.

FIG. 3 represents a sequence when the sheet 1 passes through the folding rolls 3 in an unfolded form. Initially, the sheet 1 is moved on the sliding table 2 as far as the vicinity of a region between a first folding roll 3 and a pressure roll 4 and at the same time the lifting table 6 is moved upward. The stop 21 is previously adjusted into the region between the folding rolls 3. The sheet 1 can assume a position in front of or between the pair of rolls 3, 4. This depends entirely on the control of the movement sequence. After passing through a first clamping point, the sheet 1 encounters the concave surface or flank 212 of the stop 21 and is led by the latter between the folding rolls 3. The folding rolls 3 grip the sheet 1 and move the latter further and smoothly.

Figure 4:
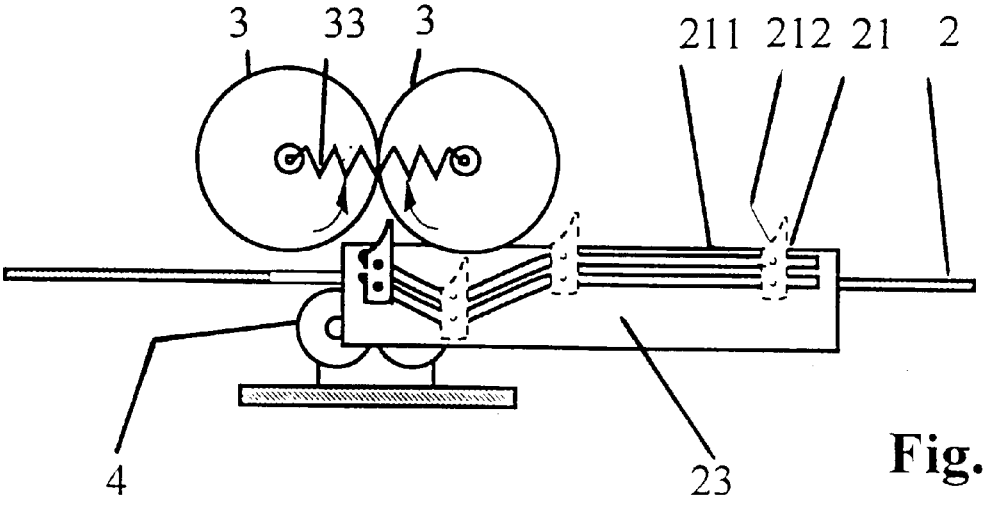
FIG. 4 is a cross-sectional view showing adjusting possibilities for the stop.

FIG. 4 shows the adjustment capabilities of the stop 21 which is shown in broken lines in various positions, through the use of a diagrammatically illustrated slotted guide 23.

Figure 5A:
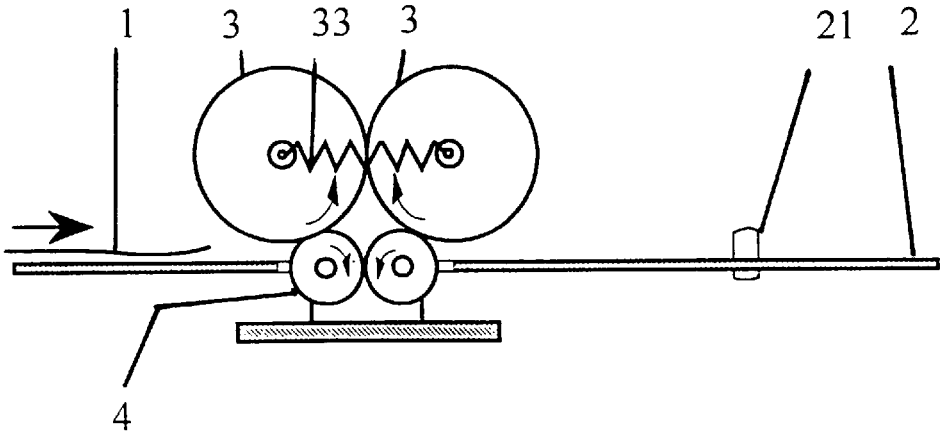
FIGS. 5*a*–5*c* are cross-sectional views showing a sequence for the "smooth passage" function without the aid of a stop.
Figure 5B:
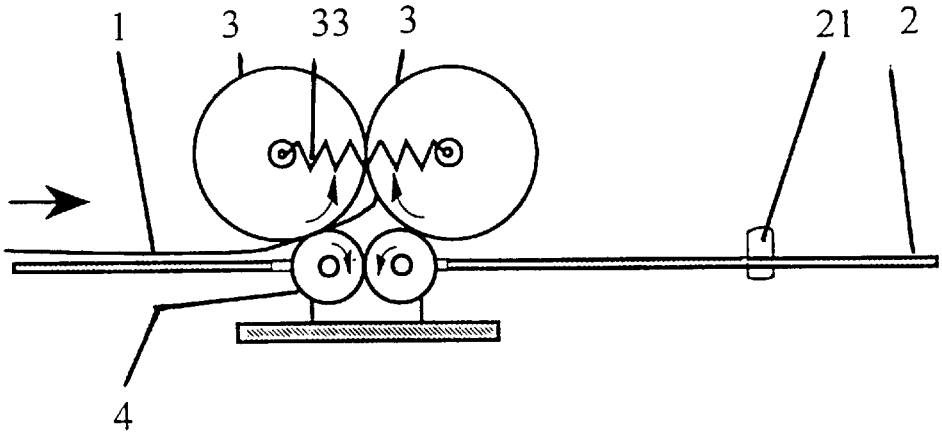
Figure 5C:
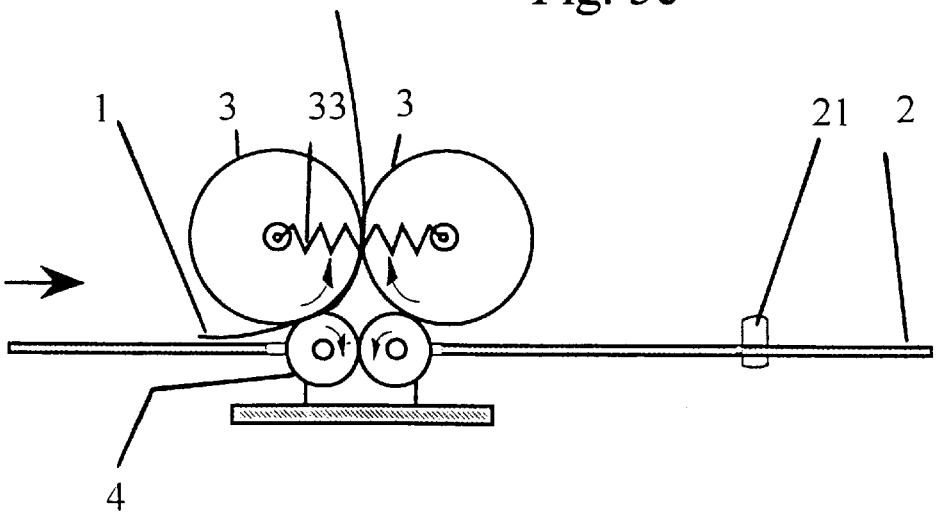

A movement sequence designated as "smooth passage" without adjusting the stop is illustrated in FIGS. 5*a*–5*c*. The sheet 1 runs on the sliding table 2 as far as the first pair of rolls 3, 4, as is seen in FIG. 5*a*. The sheet is moved further by these rollers, the front edge of the sheet encounters the second folding roll 3 and the sheet is deflected by the folding roll 3 into the folding region and passes the latter, as is seen in FIGS. 5*b* and 5*c*.

Figure 6A:
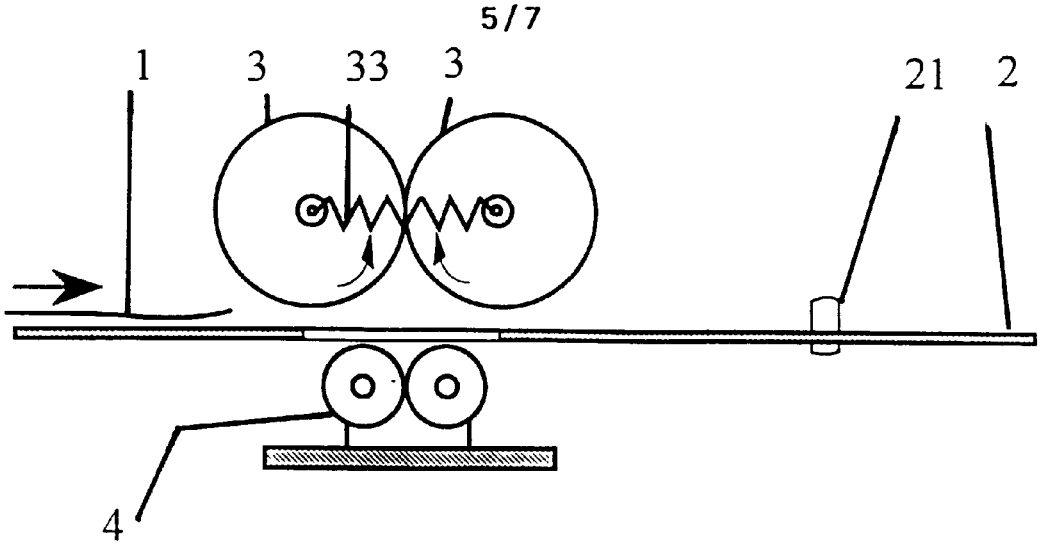
FIGS. 6*a*–6*d* are cross-sectional views showing a sequence for a "turning and smooth passage" function.
Figure 6B:
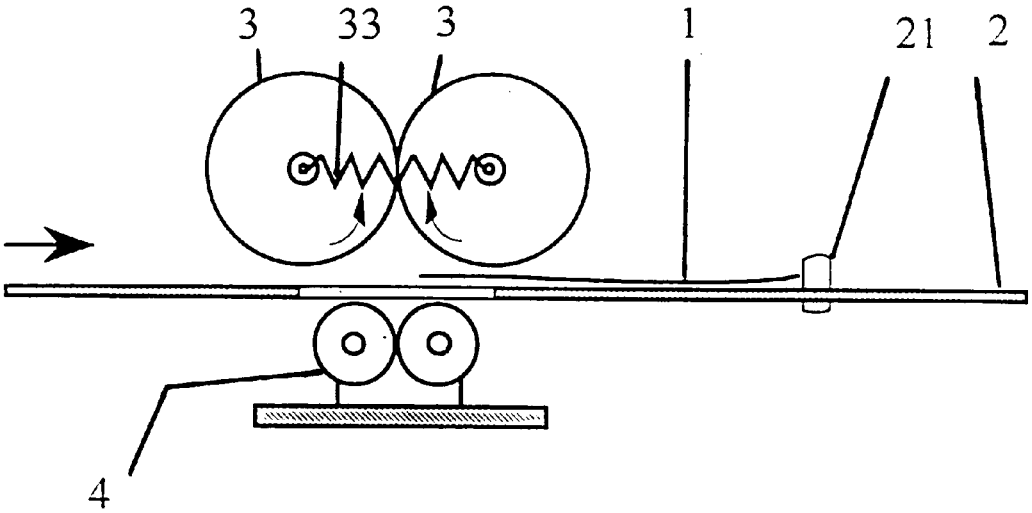
Figure 6C:
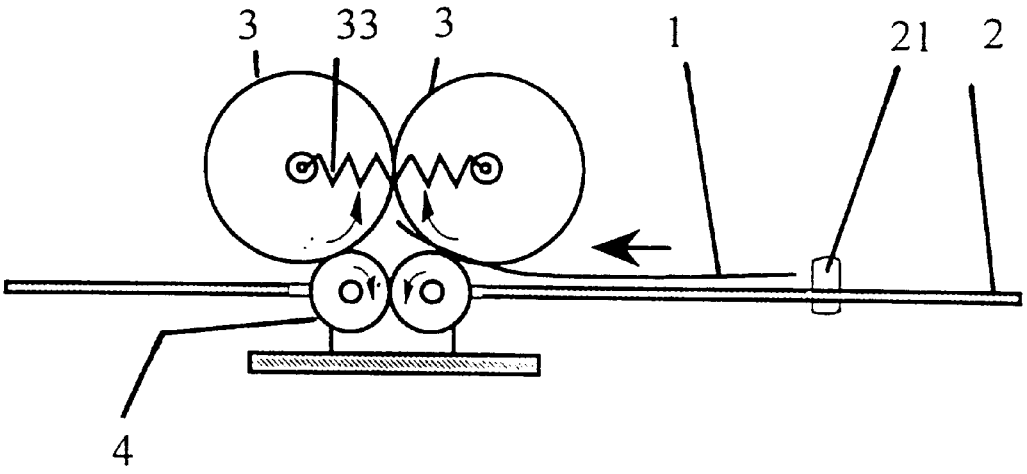
Figure 6D:
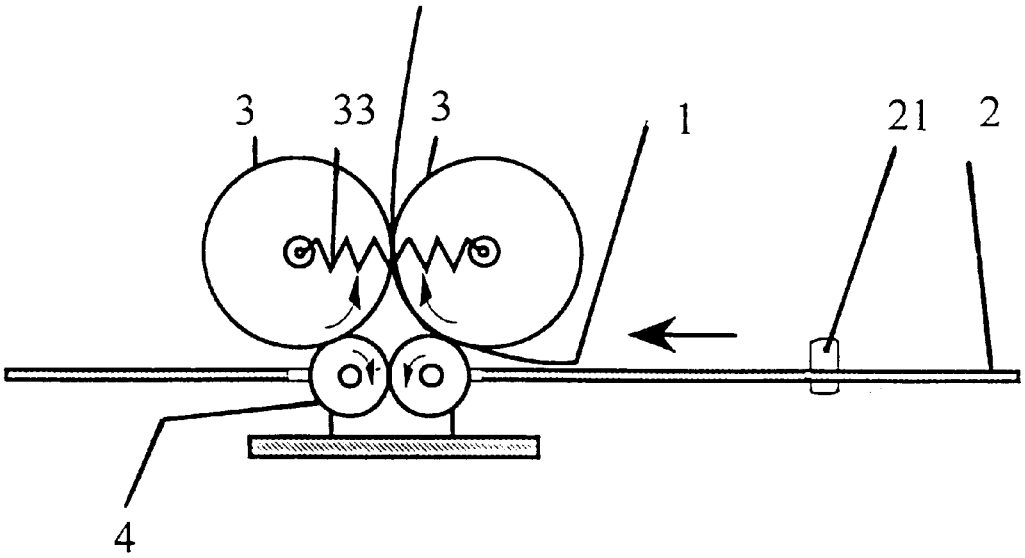

The movement sequence of the "turning and smooth passage" function is represented in FIGS. 6*a*–6*d*. Initially, the sheet 1 passes the region between the pressure and folding rolls 4, 3 until it reaches the stop 21, as is seen in FIGS. 6*a* and 6*b*. In this case, the lifting table 6 assumes the lower position at a distance. The stop 21 is set in such a way that the sheet 1 rests with its trailing part between the second pressure roll 4 and second folding roll 3. If the lifting table 6 is moved upward, then the trailing part of the sheet 1 is clamped-in between the rolls and guided in the direction of the first folding roll 3, the sheet is deflected by the latter between the folding rolls 3 and the sheet 1, which is turned in this manner, passes through smoothly, as is seen in FIGS. 6*c* and 6*d*.

Figure 7:
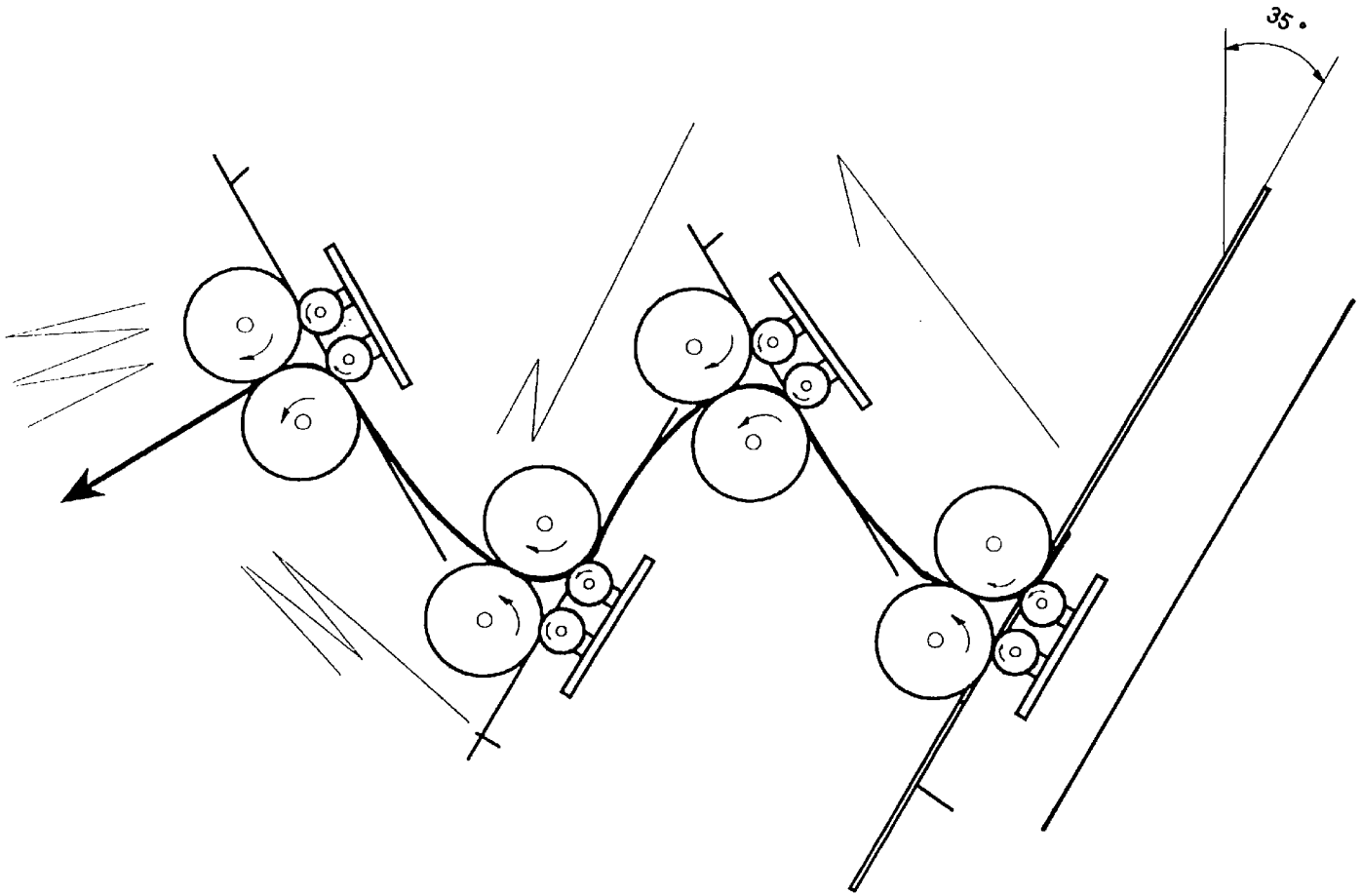
FIG. 7 is a cross-sectional view showing a configuration for multiple folding.

In FIG. 7, a plurality of folding configurations according to the invention are disposed one after another and offset relative to one another. In order to ensure that the advantage of the movement sequence with the sliding table 2 dropping at 35° is utilized, in this case the pressure rolls are disposed above, and the folding rolls below, the associated sliding table. The black, unbroken line in the representation signifies the course of the sheet. The respective folding state is drawn in as an accompanying symbol. The end result in the case of three folding configurations is a fourfold continuous fold.

According to FIG. 8, further driving guide rolls 9 are provided alongside the folding rolls 3. The guide rolls 9 are disposed on both sides of the folding rolls 3, they are parallel thereto and they run in the same direction. Further pressure rolls assigned to the guide rolls 9 are mounted on a correspondingly broadened lifting table 6. This configuration is conceived for reliable guidance of particularly short material to be folded or short sheets which are not to be folded.

FIG. 9 shows an alternative of a resilient mounting of the folding rolls 3. The folding rolls 3 are supported in this case with their axles 31 in pivotable bearings 32. The pivotable bearings 32 are constructed as rotatable levers, between which a tension spring 33 is clamped in each case. The bearings 32 are, for their part, rotatably fastened with their axles or shafts 322 in bearing blocks 34.

We claim:

1. A configuration for folding sheets, comprising:

a pair of axially parallel folding rolls resting resiliently on each other and having a given diameter;

a pair of axially parallel pressure rolls axially symmetrical to said folding rolls, adjustable in relation to said folding rolls, disposed upstream of said folding rolls in a sheet running direction, and having a diameter less than half of said given diameter, said pressure rolls being distributed in axial direction defining gaps therebetween; and a subdivided stop acting as a diverting element and having an adjustment path projecting into said gaps between said pressure rolls, said subdivided stop can divert a sheet through said folding rolls in an unfolded state.

2. The configuration according to claim 1, including a lifting table on which said pressure rolls are fastened in common.

3. The configuration according to claim 1, including a sliding table for sheets, said sliding table having cutouts matched to said pressure rolls in a lifting region of said pressure rolls, and said sliding table having a guide underneath said folding rolls in said adjustment region of said stop for lowering and raising said stop.

4. The configuration according to claim 1, including a sliding table for a sheet, said sliding table having cutouts matched to said pressure rolls in a lifting region of said pressure rolls.

5. The configuration according to claim 3, wherein said sliding table is inclined downward in said sheet running direction.

6. The configuration according to claim 3, wherein said sliding table is inclined downward in said sheet running direction at an angle of 35°.

7. The configuration according to claim 4, wherein said sliding table is inclined downward in said sheet running direction.

8. The configuration according to claim 4, wherein said sliding table is inclined downward in said sheet running direction at an angle of 35°.

9. The configuration according to claim 3, wherein said stop has a flat part facing said sliding table and a concave part facing away from said sliding table being matched to a curvature of said folding rolls.

10. The configuration according to claim 4, wherein said stop has a flat part facing said sliding table and a concave part facing away from said sliding table being matched to a curvature of said folding rolls.

11. The configuration according to claim 3, wherein said folding rolls are disposed above and said pressure rolls are disposed below said sliding table.

12. The configuration according to claim 4, wherein said folding rolls are disposed above and said pressure rolls are disposed below said sliding table.

13. The configuration according to claim 3, wherein said folding rolls are disposed below and said pressure rolls are disposed above said sliding table.

14. The configuration according to claim 4, wherein said folding rolls are disposed below and said pressure rolls are disposed above said sliding table.

15. The configuration according to claim 1, including axles for said folding rolls, fixed bearings having slots formed therein for mounting said axles, and tension springs interconnecting said axles causing said folding rolls to rest resiliently on each other.

16. The configuration according to claim 15, wherein said tension springs have a maximum spring travel corresponding to a maximum thickness of a material to be folded and to be processed.

17. A configuration for folding sheets, comprising:

a pair of axially parallel folding rolls resting resiliently on each other and having a given diameter;

pivotable bearings mounting said folding rolls;

tension springs interconnecting said pivotable bearings;

a pair of axially parallel pressure rolls axially symmetrical to said folding rolls, adjustable in relation to said folding rolls, disposed upstream of said folding rolls in a sheet running direction, and having a diameter less than half of said given diameter, said pressure rolls being distributed in axial direction defining gaps therebetween; and a subdivided stop acting as a diverting element and having an adjustment path projecting into said gaps between said pressure rolls.

18. The configuration according to claim 17, wherein said tension springs have a maximum spring travel corresponding to a maximum thickness of a material to be folded and to be processed.

19. The configuration according to claim 2, including guide rolls parallel to said folding rolls and driven at the same peripheral speed, and further pressure rolls assigned to said guide rolls and parallel to said folding rolls.

20. An assembly for folding sheets, comprising:

a plurality of folding configurations disposed alternately and mutually orthogonally offset in a sheet running direction, each of said configurations including:

a sliding table for sheets;

a pair of axially parallel folding rolls resting resiliently on each other below said sliding table and having a given diameter;

a pair of axially parallel pressure rolls disposed above said sliding table, axially symmetrical to said folding rolls, adjustable in relation to said folding rolls, upstream of said folding rolls in the sheet running direction, and having a diameter less than half of said given diameter, said pressure rolls being distributed in axial direction defining gaps therebetween; and a subdivided stop acting as a diverting element and having an adjustment path projecting into said gaps between said pressure rolls, said subdivided stop can divert a sheet through said folding rolls in an unfolded state.

* * * * *